US006340294B1

(12) United States Patent
Kubota et al.

(10) Patent No.: US 6,340,294 B1
(45) Date of Patent: Jan. 22, 2002

(54) DIAPHRAGM TYPE FUEL PUMP

(75) Inventors: Kenichi Kubota; Noriaki Chiba, both of Morioka (JP)

(73) Assignee: Mikuni Adec Corporation (JP)

( * ) Notice: Subject to any disclaimer, the term of this patent is extended or adjusted under 35 U.S.C. 154(b) by 0 days.

(21) Appl. No.: 09/648,466

(22) Filed: Aug. 28, 2000

(30) Foreign Application Priority Data

Oct. 27, 1999 (JP) ..... 11-304991

(51) Int. Cl.[7] ..... F04B 43/06
(52) U.S. Cl. ..... 417/395; 92/98 R; 92/103 R
(58) Field of Search ..... 92/98 R, 103 R, 92/103 SD; 417/395

(56) References Cited

U.S. PATENT DOCUMENTS 2,307,066 A * 1/1943 Paulus
2,730,131 A * 1/1956 Asp et al.
2,764,097 A * 9/1956 Browne
6,173,959 B1 * 1/2001 Oikawa et al.

* cited by examiner

*Primary Examiner*—Michael Koczo
(74) *Attorney, Agent, or Firm*—Lorusso & Loud

(57) ABSTRACT

A diaphragm 46 is sandwiched between a first body 16 and a second body 18, and comprises an outer diaphragm 50 which is made of synthetic resin and has an opening 48 formed within an effective diameter X, and an inner diaphragm 52 arranged in the opening 48. The outer and inner diaphragms 50 and 52 are hermetically sealed by a coupling member 54 made of rubber. Therefore, the diaphragm 46 reciprocates as a synthetic resin diaphragm at very low temperatures. At normal temperatures, the inner diaphragm 52 reciprocates extensively via the rubber coupling member 54 compared with the outer diaphragm 50, thereby increasing a flow rate of the fuel pump compared with a fuel pump in which a diaphragm is made only of synthetic resin. When the diaphragm 46 is replaced depending upon a desired flow rate, the second body 18 can be manufactured using one die, which is effective in reducing manufacturing costs.

4 Claims, 10 Drawing Sheets

DIAPHRAGM TYPE FUEL PUMP

BACKGROUND OF THE INVENTION

1. Field of the Invention

This invention relates to a diaphragm type fuel pump which feeds fuel in response to reciprocations of a diaphragm.

2. Description of the Related Art

A diaphragm type fuel pump has been utilized as a fuel supply for feeding fuel to a fuel injector from a fuel tank. An example of such a fuel pump is shown in FIG. 8 of the accompanying drawings.

A diaphragm type fuel pump 10 comprises: a first body 16 including a fuel introducing path 12 and a fuel discharging path 14; a second body 18 arranged on one side of the first body 16; a cover 20 arranged on the other side of the first body 16; a diaphragm 22 sandwiched between the first and second bodies 16 and 18; and a membrane 24 sandwiched between the first body 16 and the cover 20.

A pump chamber 28 is formed between the diaphragm 22 and the first body 16, while a pulse chamber 30 is formed between the diaphragm 22 and the second body 18. The pump chamber 28 communicates with both the fuel introducing path 12 and fuel discharging path 14 of the first body 16. The second body 18 is provided with a pulse introducing path 32 in order to introduce pulse pressure to the pulse chamber 30. The pulse pressure is generated by an engine and is supplied to the pulse chamber 32 via the pulse introducing path 32.

A fuel sucking chamber 34 communicating with a fuel tank (not shown) and a fuel discharging chamber 35 communicating with a fuel injector (not shown) are formed between the membrane 24 and the first body 16. Between the membrane 24 and the cover 20, a damping chamber 36 faces the fuel sucking chamber 34 via the membrane 24, and a damping chamber 37 faces the fuel discharging chamber 35 via the membrane 24.

The fuel sucking chamber 34 communicates with the pump chamber 28 via the fuel introducing path 12 of the first body 16, while the fuel discharging chamber 35 communicates with the pump chamber 28 via the fuel discharging path 14 of the first body 16. A check valve 38 is provided in the fuel introducing path 12 in order to feed fuel only to the pump chamber 28 from the fuel sucking chamber 38. Further, a check valve 40 is provided in the fuel discharging path 14 in order to feed fuel only to the fuel discharging chamber 35.

In this diaphragm type fuel pump 10, pulse pressure generated in a crank chamber (not shown) of the engine is introduced into the pulse chamber 30, thereby reciprocating the diaphragm 22 between the pump chamber 28 and the pulse chamber 30. As a result, fuel introduced into the fuel sucking chamber 34 from the fuel tank is supplied to the fuel injector via the pump chamber 28 and the fuel discharging chamber 35.

The diaphragm 22 is generally made of a rubber or synthetic resin material. The rubber material becomes hard at a low temperature, and tends not to reciprocate smoothly, thereby reducing the flow rate of the fuel pump. On the contrary, a synthetic resin material that remains flexible regardless of temperature variations has been utilized for snow mobiles or the like which are structured so as to be usable in very cold areas.

FIG. 9 shows the diaphragm 22 made of only synthetic resin in the related art. The diaphragm 22 is flat, and has openings 42 at four corners in which screws (not shown) are received in order to fixedly hold the first body 16 and two lids 18 and 20.

At normal temperatures, the synthetic resin is hard compared with the rubber material, so that the synthetic resin diaphragm 22 is less flexible than the rubber diaphragm, and takes time to reciprocate. The fuel pump including a synthetic resin diaphragm 22 therefore suffers from a reduced flow rate compared with a fuel pump including a rubber diaphragm 22.

It is well-known that the flow rate of the diaphragm type fuel pump depends upon a size of an effective diameter X (shown in FIG. 8) of the diaphragm 22. The term "effective diameter" means a diameter of the diaphragm in which the pumping operation is performed. Referring to FIG. 8, the effective diameter X of the diaphragm 22 is equal to a diameter of an inner wall of the second body 18 constituting the cylindrical pulse chamber 30.

FIG. 10 is a graph showing the relationship (N-Q characteristics) between the number N of pulses and flow rate Q of pumps 10 having the synthetic resin diaphragm 22 and two different effective diameters X. In FIG. 10, black squares ■ denote the N-Q characteristics of a fuel pump having a relatively small effective diameter diaphragm (for a maximum flow rate of 42 L/H), and black circles ● denote the N-Q characteristics of a fuel pump having a relatively large effective diameter diaphragm (for a maximum flow rate of 72 L/H). Referring to the N-Q characteristics, it is understood that the effective diameter extensively affects the flow rate of the fuel pump.

In the related diaphragm type fuel pump 10, a variety of second bodies 18 have been prepared in accordance with required flow rates of the fuel pump. Since the different flow rates mean the necessity of different effective diameters X, the second bodies 18 have been selected in accordance with the required flow rates. As a result, a plurality of dies have been required, which has caused an increase in manufacturing costs of fuel pumps.

The invention is intended to overcome the foregoing problems of the related art, and to provide a diaphragm type fuel pump that includes a single kind of body, meets requirements for a plurality of flow rates and can be manufactured at a reduced cost.

According to the present invention, at very low temperatures, the diaphragm of the fuel pump can assure strokes identical to those of the synthetic resin diaphragm of the related art and having an effective diameter X that is the same as that of the present invention. At normal temperatures, the diaphragm of the invention can assure large strokes compared with those of the synthetic resin diaphragm, and increases necessary flow rates. Therefore, the flow rates can be varied as desired only by exchanging the diaphragm but without replacing the second body. As a result, it is not necessary to prepare a plurality of dies, which is effective in promoting the use of just one type of second body and reducing manufacturing costs.

SUMMARY OF THE INVENTION

In order to accomplish the foregoing object of the invention, there is provided a diaphragm type fuel pump comprising: a fuel sucking chamber and a fuel discharging chamber; a first body having a fuel introducing path communicating with the fuel sucking chamber and a fuel discharging path communicating with the fuel discharging chamber; a diaphragm fixed to the first body using a second body; and a pump chamber constituted by the diaphragm and the first body and communicating with the fuel introducing path and the fuel discharging path. The diaphragm includes an outer diaphragm made of resin and having an opening formed within an effective diameter of the diaphragm, and an inner diaphragm arranged in the opening of the outer diaphragm. Further, the outer and inner diaphragms are mutually fixed using an elastic coupling member.

DETAILED DESCRIPTION OF THE PREFERRED EMBODIMENT

Figure 1:
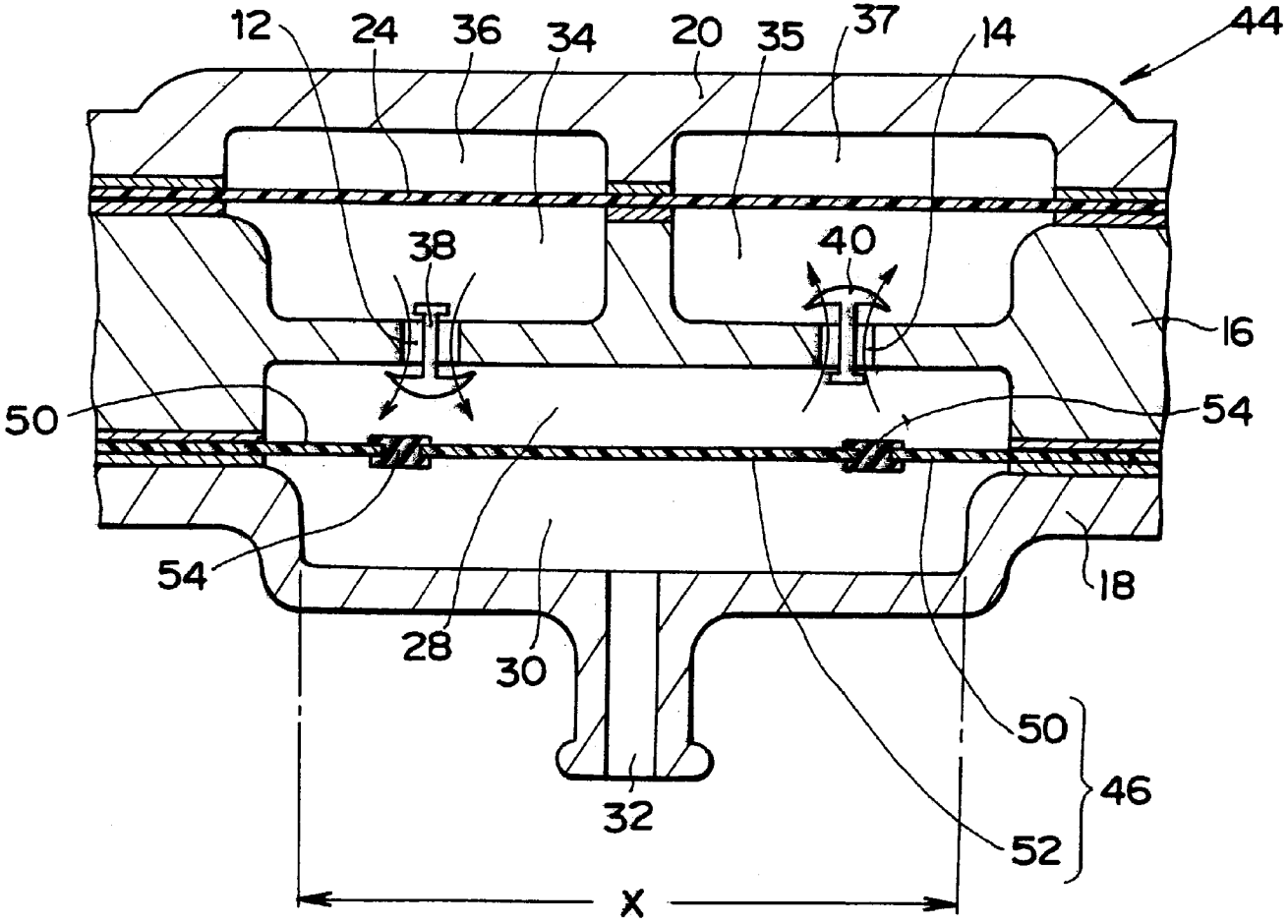
FIG. 1 is a sectional view of the diaphragm type fuel pump according to one embodiment of the invention.
Figure 2:
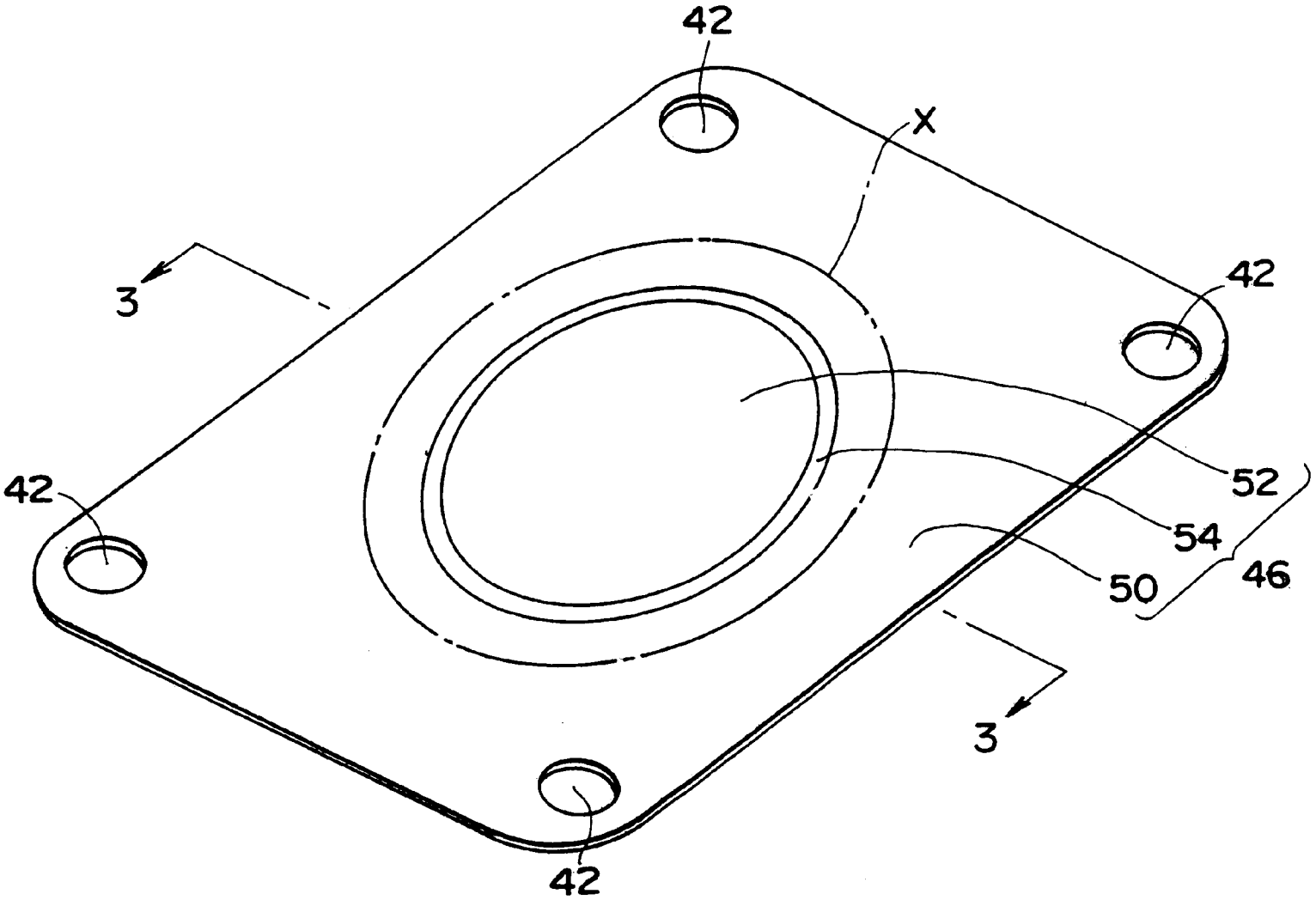
FIG. 2 is a perspective view of the diaphragm used in the invention.
Figure 3:
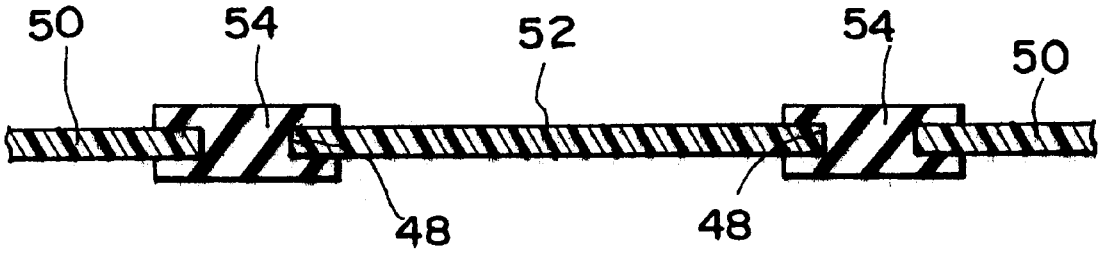
FIG. 3 is a sectional view of the diaphragm, taken along line 3—3 in FIG. 2.
Figure 8:
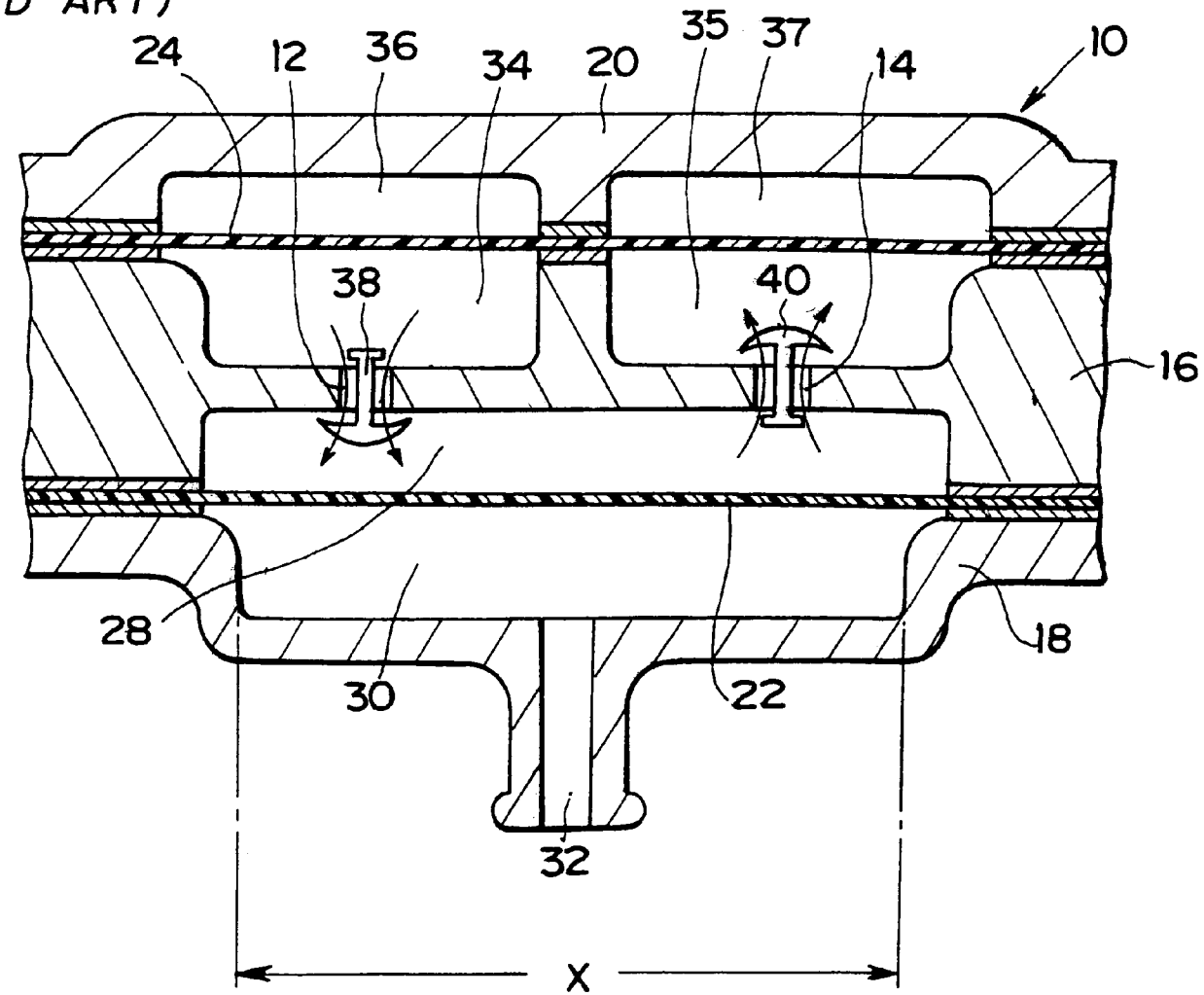
FIG. 8 (RELATED ART)
FIG. 8 is a sectional view of the diaphragm type fuel pump of the related art.
Figure 9:
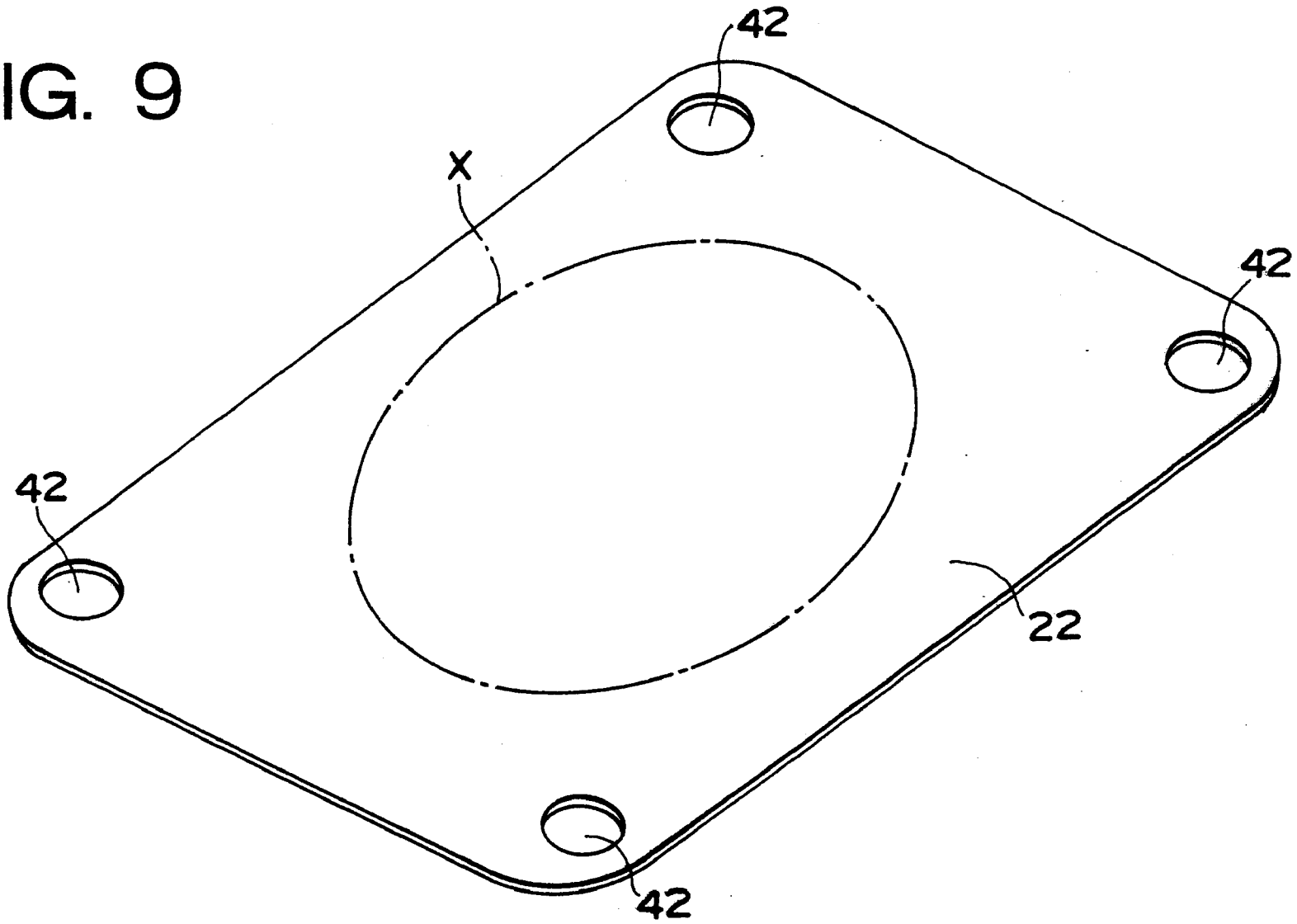
FIG. 9 is a perspective view of the diaphragm of FIG. 8.

The invention will be described with reference to the drawings. FIG. 1 is a sectional view of a diaphragm type fuel pump according to one embodiment of the invention. FIG. 2 is a perspective of a diaphragm used in the invention. FIG. 3 is a sectional view of the diaphragm taken along line 3—3 in FIG. 2. In FIGS. 1 and 8, like or corresponding parts are denoted by like or corresponding reference numerals.

The diaphragm type fuel pump 44 of the invention is composed of components which are similar to those of the related diaphragm type fuel pump 10, with the exception of the diaphragm 46. Components other than the diaphragm 46 will therefore not be described here.

The diaphragm 46 is composed of: an outer diaphragm 50 having a center opening 48 (see FIG. 3); an inner diaphragm 52 fitted into the center opening 48; and an annular coupling member 54 for fixedly coupling the outer and inner diaphragms 50 and 52. Referring to FIG. 3, the inner diaphragm 52 and the outer diaphragm 50 are flush with each other as shown in FIG. 3, and are made of synthetic resin materials. The annular coupling member 54 is made of an elastic material such as rubber.

With the diaphragm 46, the outer diaphragm 50 is sandwiched between a first body 16 and a second body 18. A diameter of the opening 48 and an outer diameter of the coupling member 54 are designed such that an effective diameter X of the diaphragm 46 is equal to an outer diameter of the outer diaphragm 50. In other words, the diameter of the opening 48 and the outer diameter of the coupling member 54 are small compared with the effective diameter X of the diaphragm 46.

The inner and outer diaphragms 50 and 52 are hermetically coupled to the coupling member 54 using adhesives. Alternatively, these components may be hermetically molded or fused. The coupling member 54 should be as strong as the outer and inner diaphragms 50 and 52.

The effective diameter X of the diaphragm 46 coincides with the outer diameter of the synthetic resin outer diaphragm 50 that is not hardened even at an extremely low temperature. Therefore, the diaphragm 46 can assure large reciprocation compared with the related diaphragm 22 made only of synthetic resin.

At normal temperatures, the inner diaphragm 52 reciprocates in an orbit which differs from an orbit of the related diaphragm 22, i.e. the center (inside the effective diameter X) of the diaphragm 22. This is because the inner diaphragm 52 is separated from the outer diaphragm 50 via the coupling member 54. In other words, the coupling member 54 made of rubber is softer than the synthetic resin at normal temperatures, so that the inner diaphragm 52 easily performs vertical strokes in response to pulses. As a result, the diaphragm 46 of the present invention reciprocates extensively compared with the related diaphragm 22 made of only synthetic resin. Further, even when the diaphragms 46 and 22 have the same effective diameters X, the fuel pump 44 of the invention can have a much larger flow rate than that of the diaphragm 22 made of only synthetic resin.

Figure 4:
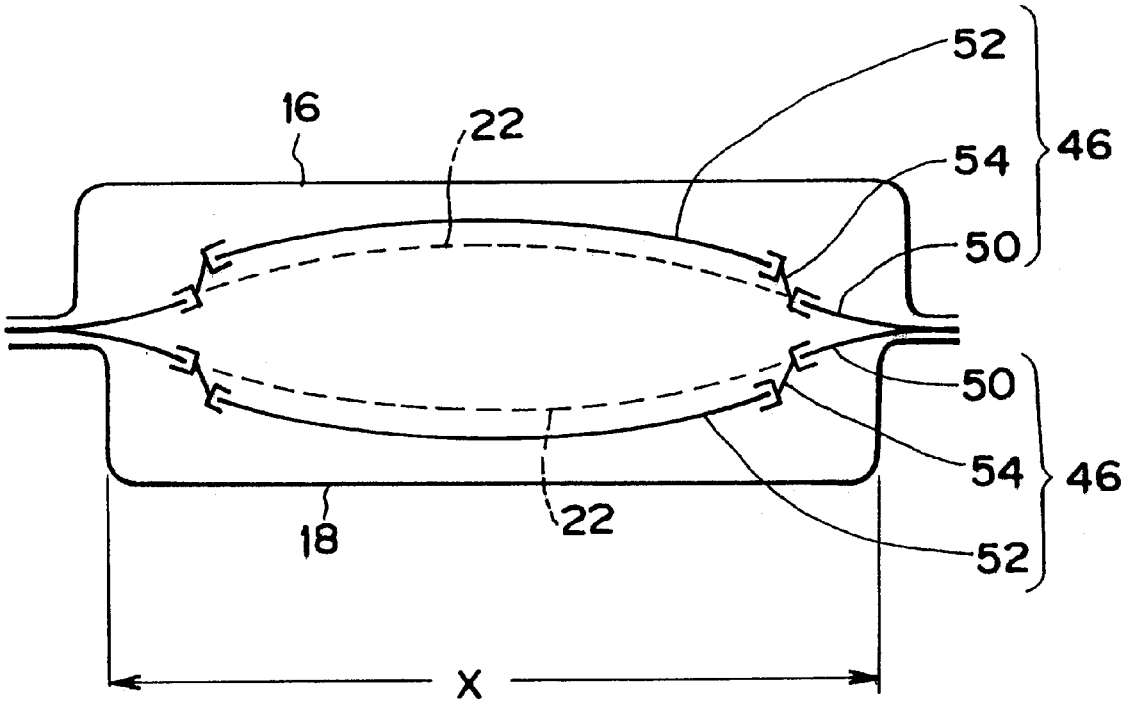
FIG. 4 is a schematic view showing strokes of the diaphragm of the invention.

FIG. 4 schematically shows how the diaphragm 46 reciprocates at normal temperatures. In FIG. 4, solid lines denote strokes of the diaphragm 46, and dashed lines denote strokes of the related synthetic resin diaphragm 22. Referring to FIG. 4, it is understood that the strokes of the diaphragm 46 are larger than those of the diaphragm 22, which means that the fuel pump of the present invention can assure a large flow rate.

Figure 5:
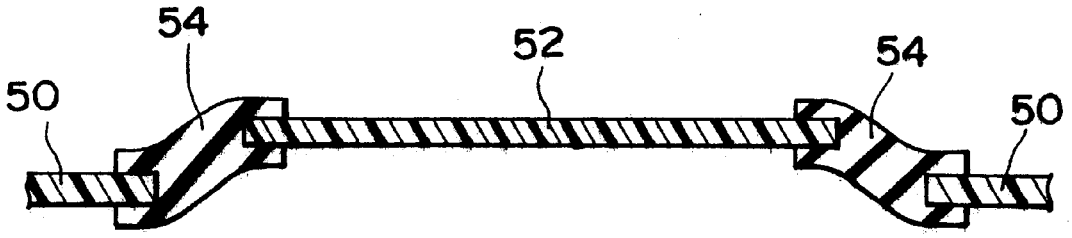
FIG. 5 is a sectional view of another example of the diaphragm of the invention.
Figure 10:
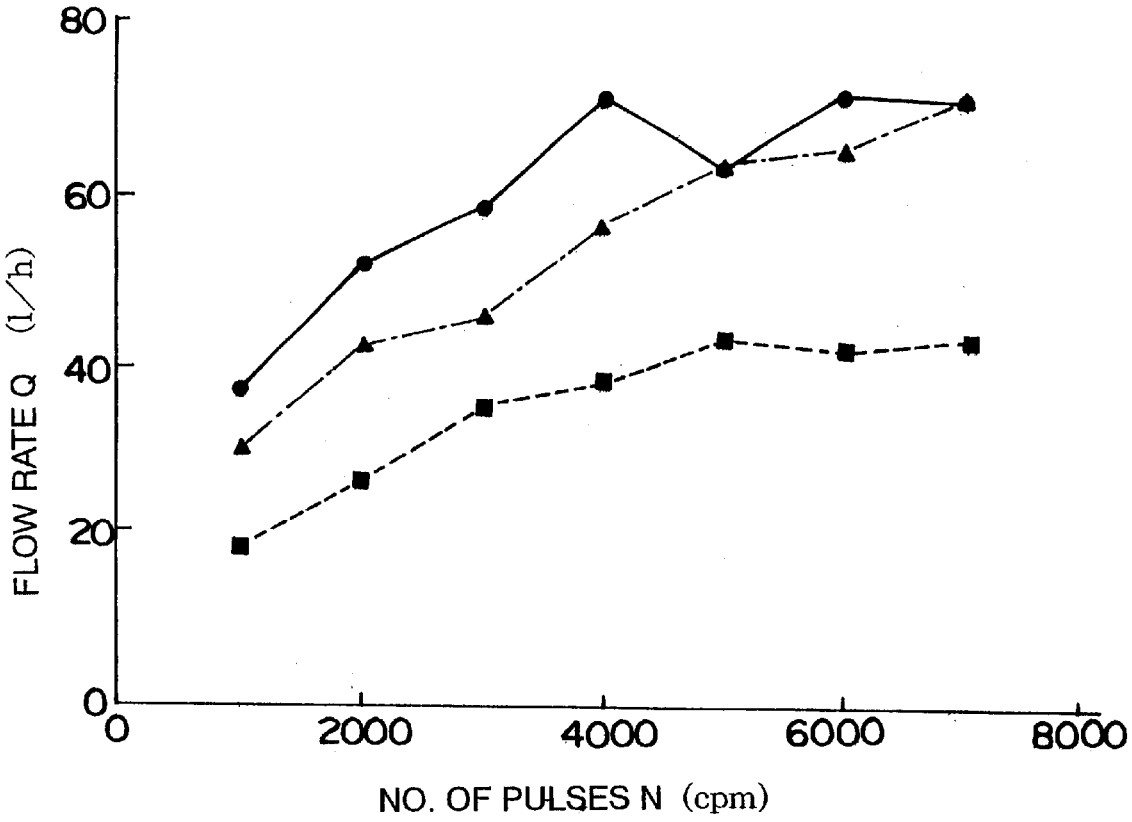
FIG. 10 is a graph showing the N-Q characteristics of the diaphragm type fuel pumps of the related art and the invention.

The N-Q characteristics of the diaphragm type fuel pump 44 including the diaphragm 46 are shown by black triangles ▲ in FIG. 10. In FIG. 5, the fuel pump 44 is provided with the second body 20 having a relatively small effective diameter (i.e. the maximum flow rate of the pump is 42 L/H) which is equal to the flow rate shown by the black squares ■.

As can be seen from the N-Q characteristics, the flow rate of the fuel pump 44 is substantially equal to the flow rate of the fuel pump including the second body 20 with the relatively large effective diameter (i.e. the maximum flow rate is 72 L/H). In short, the fuel pump 44 having the second body 20 with the relatively small effective diameter (i.e. the maximum flow rate of 42 L/H) can assure the flow rate that is equal to the flow rate of the related pump having the relatively large effective diameter (i.e. the maximum flow rate of 72 L/H). Therefore, according to the present invention, even when the same second body 20 is used, desired flow rates can be obtained by replacing the diaphragm 46. In other words, one kind of the second body 20 is usable regardless of the required flow rates.

A further example of the diaphragm 46 will be described hereinafter.

In this example, the coupling member 54 is curved so that the synthetic resin inner and outer diaphragms 52 and 50 are not flush with each other at normal temperatures. If the coupling member 54 is made of synthetic resin, it cannot be curved but remains flat. On the contrary, if it is made of a rubber material, the coupling member 54 can be shaped as desired, which is effective in enlarging strokes of the diaphragm 46. When the inner and outer diaphragms 54 and 52 are not flush with each other due to curving the coupling member 54 as shown in FIG. 5, the diaphragm stroke can be increased compared with the diaphragm in FIG. 3, so that the flow rate of the fuel pump can be increased.

Figure 6:
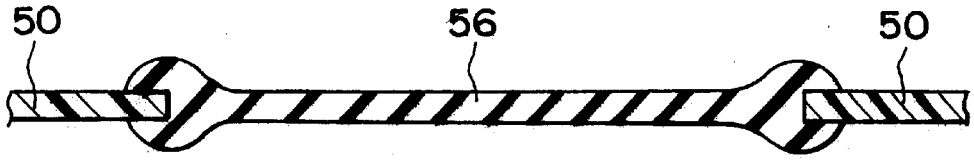
FIG. 6 is a sectional view of a further example of the diaphragm of the invention.

The outer and inner diaphragms 50 and 52 are not always made of the same material, and may be made of different materials. For instance, the outer diaphragm 50 may be of a synthetic resin material while the inner diaphragm 52 may be made of an elastic material such as rubber. In the latter case, the inner diaphragm 52 (shown in FIG. 3) and the coupling member 54 may be integrally formed as an inner diaphragm 56 as shown in FIG. 6.

Figure 7:
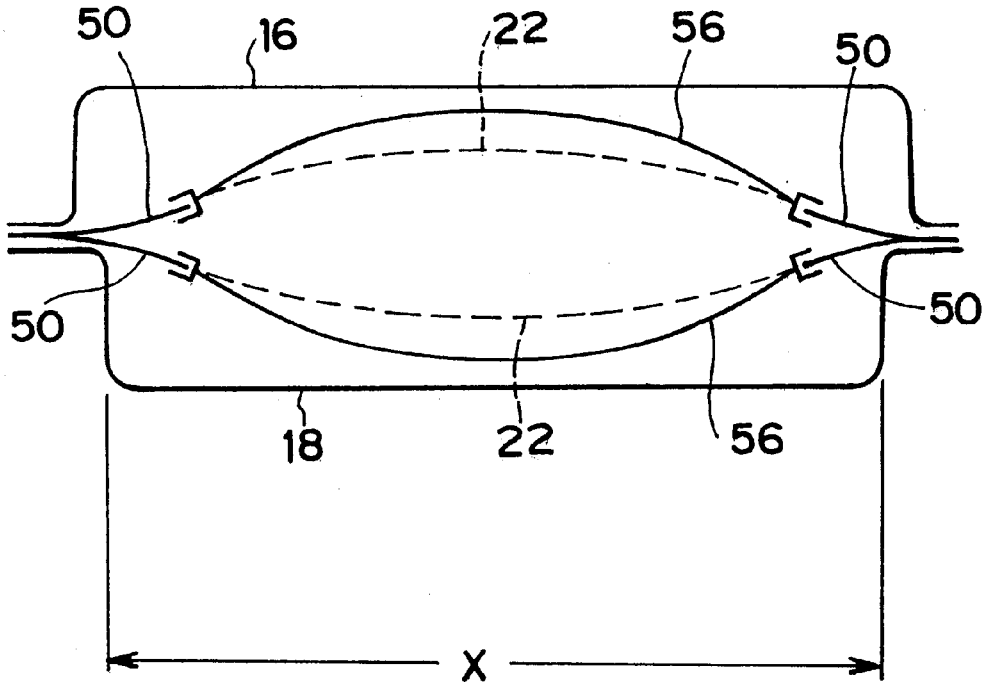
FIG. 7 is a schematic view showing strokes of the diaphragm in FIG. 6.

Strokes of the inner diaphragm 56 at normal temperatures are schematically shown in FIG. 7. In FIG. 7, solid lines denote strokes of the diaphragm 56 of the present invention, while dashed lines denote strokes of the related diaphragm 22 made of synthetic resin. Referring to FIG. 7, the rubber material is more elastic than the synthetic resin at normal temperatures, so that the rubber diaphragm 56 of the present invention can assure large strokes compared with those of the synthetic resin diaphragm 22 of the related art.

Further, it is not always necessary that the outer and inner diaphragms 50 and 52 have the same thickness. Still further, the inner diaphragm 52 may be in the shape of a plate instead of in the shape of a membrane (as long as the diaphragm 52 does not curl during the stroke operation).

What is claimed is:

1. A diaphragm type fuel pump comprising: a fuel sucking chamber and a fuel discharging chamber; a first body having a fuel introducing path communicating with the fuel sucking chamber and a fuel discharging path communicating with the fuel discharging chamber; a diaphragm fixed to the first body using a second body; and a pump chamber constituted by the diaphragm and the first body and communicating with the fuel introducing path and the fuel discharging path, wherein the diaphragm includes an outer diaphragm made of resin and having an opening formed within an effective diameter of the diaphragm, and an inner diaphragm arranged in the opening of the outer diaphragm, and the outer and inner diaphragms are mutually fixed using an elastic coupling member.

2. The diaphragm type fuel pump of claim 1, wherein the inner diaphragm is made of synthetic resin.

3. The diaphragm type fuel pump of claim 1, wherein the coupling member is made of an elastic material.

4. The diaphragm type fuel pump of claim 1, wherein the inner diaphragm and the elastic coupling member are made in an integral manner.

* * * * *